United States Patent [19]

Ensing et al.

[11] Patent Number: 4,607,947

[45] Date of Patent: Aug. 26, 1986

[54] CONTACT FIXING AND CLEANING METHOD AND APPARATUS

[75] Inventors: Hendrik Ensing, Velden; Jacobus H. M. Peulen, Haelen, both of Netherlands

[73] Assignee: Océ-Nederland B.V., Venlo, Netherlands

[21] Appl. No.: 671,953

[22] Filed: Nov. 16, 1984

[30] Foreign Application Priority Data

Nov. 30, 1983 [NL] Netherlands ..... 8304099

[51] Int. Cl.[4] ..... G03G 21/00

[52] U.S. Cl. ..... 355/15; 15/256.51; 15/256.52; 134/1; 355/3 FU

[58] Field of Search ..... 355/3 R, 3 FU, 15; 15/1.5 R, 256.51, 256.52; 134/1

[56] References Cited

U.S. PATENT DOCUMENTS

| | | | |
|---|---|---|---|
| 3,649,992 | 3/1972 | Thettu | 15/256.52 |
| 3,706,491 | 12/1972 | Furman et al. | 15/1.5 R X |
| 3,781,107 | 12/1973 | Ruhland | 355/15 |
| 3,976,814 | 8/1976 | Murphy | 427/226 |
| 4,086,871 | 5/1978 | Rydeen et al. | 118/16 |
| 4,324,482 | 4/1982 | Szlucha | 355/15 X |
| 4,411,042 | 10/1983 | Sakata et al. | 15/256.51 |

*Primary Examiner*—Fred L. Braun

*Attorney, Agent, or Firm*—Albert C. Johnston; Thaddius J. Carvis

[57] ABSTRACT

In a contact fixing system in which a heat-softened toner image is fixed onto a sheet material by being pressed against the sheet material in a nip between the peripheral surfaces of two circulating fixing members, such as rollers pressing one against the other or a roller pressing against an image carrying belt, residues of the toner of an image and paper dust are removed from the surface of a fixing member in a cleaning zone beyond the fixing nip by moving in rolling contact with that surface a circulating cleaning surface, such as a roller surface, to which the toner adheres preferentially and which has a multiplicity of spaced-apart perforations formed therein and so disposed that with continued movements of the cleaning surface through the cleaning zone a toner layer formed on the cleaning surface is repeatedly pressed thin and excess toner present in it is displaced to the perforations for discharge through them into a cavity inside the cleaning member.

18 Claims, 2 Drawing Figures

CONTACT FIXING AND CLEANING METHOD AND APPARATUS

Figure 2:
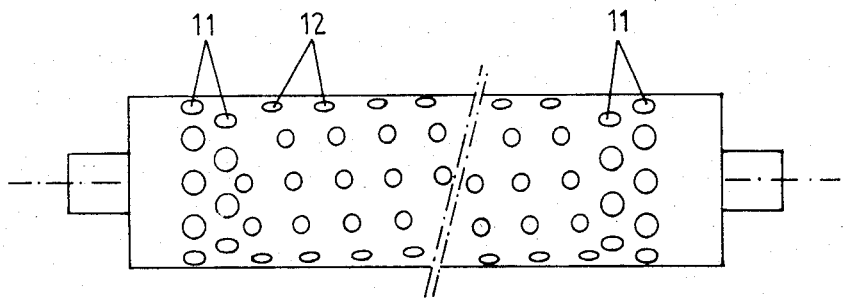

This invention relates to improvements useful in copiers, particularly for the effective removal of residual toner and paper dust from sheet contacting surfaces in a contact fixing apparatus for fixing heat-softened toner images onto sheet materials.

Xerographic copiers form images composed of heat-softenable toner particles. To make the images permanent, they are fixed onto sheet material such as paper. This can be accomplished in a number of ways. According to one fixing procedure, a circulating heated roller or belt presses the toner image against a sheet material which is supported on the opposite side by a suitable circulating pressure member such as a roller or belt. This procedure, sometimes referred to as contact fixing, often leaves residues of toner particles and paper dust attached to the sheet contacting surfaces. These residues, if allowed to remain on the sheet contacting surfaces, can be transferred to a sheet and will adversely affect copy quality.

U.S. Pat. No. 3,649,992 discloses a contact fixing apparatus which addresses this concern. According to this patent, the surface of a contact fixing roller is brought into direct contact with a metal cleaning roller. Residues of paper dust and toner carried on the surface of the contact fixing roller adhere preferentially to the cleaning roller surface and are thus removed from the contact fixing roller. The use of a metal roller in this way, however, has the disadvantage that an uneven layer of toner gradually builds up on it, so that shallow parts of the toner layer close to high parts thereof cease to exert a cleaning effect because the contact between the contact fixing surface and these shallow parts is inadequate. Also the toner layer becomes too thick, and as the contact fixing roller cools after being stopped in the heated condition, ribs form in the built-up toner layer parallel to the axis of the cleaning roller.

U.S. Pat. No. 4,411,042 also discloses a contact fixing apparatus including means to clean residual toner and paper dust from a sheet contacting surface. According to that disclosure, a perforated cleaning member is pressed against the surface of a rotating pressure roller. The pressure roller is also in pressing contact with a fixing roller that presses against the toner image. Deposits of toner and paper particles adhere to the surface of the pressure roller when it runs in direct contact with the image engaging fixing roller. The surface of the pressure roller moves relative to the perforated cleaning member during movement of the pressure roller so that the deposits are scraped off by edge portions of the perforations to keep the surface of the pressure roller clean.

The object of this invention is to provide, in an apparatus for fixing toner images made of heat-softenable toner powder, improved means and a method for cleaning toner residues and paper dust from the surface of a circulating fixing member, such as a roller or a belt, that runs in contact with an image bearing member or an image receiving material in a contact fixing zone of the apparatus.

To this end, according to the invention, a circulating cleaning member having a surface carrying a toner layer to which the toner and paper dust will adhere preferentially rather than to the surface of a circulating fixing member to be cleaned has its said surface held against and moved with the fixing member surface in a contact cleaning zone located beyond the contact fixing zone, and the surface of the cleaning member is provided with a multiplicity of spaced-apart openings, or perforations, which extend through it for discharging residues from it, for instance, into a cavity inside the cleaning member. By moving in contact with the moving fixing member surface to be cleaned, the surface of the cleaning member collects residues of toner and paper dust from the surface to be cleaned and presses them into the toner layer on the cleaning member surface. This layer is pressed thin upon each movement of it through the contact cleaning zone; and as the toner layer builds up, the rolling action of the contacting surfaces in the cleaning zone displaces excess material present in the toner layer to openings in the cleaning member surface for delivery through them away from the cleaning zone. This not only reduces unevenness of the toner layer but also ensures that only a thin layer of toner is maintained on the cleaning member.

According to a further feature of the invention, a line of pressure inclined relative to the direction of movement of the fixing member surface is maintained in the contact cleaning zone between the surface of the cleaning member and the fixing member surface so that a lateral component of displacement is continually imparted to material in the toner layer on the cleaning member surface. This results in a more rapid delivery of excess toner into the openings in the cleaning member surface and promotes the maintenance of a thin uniform layer of toner on that surface.

Figure 1:
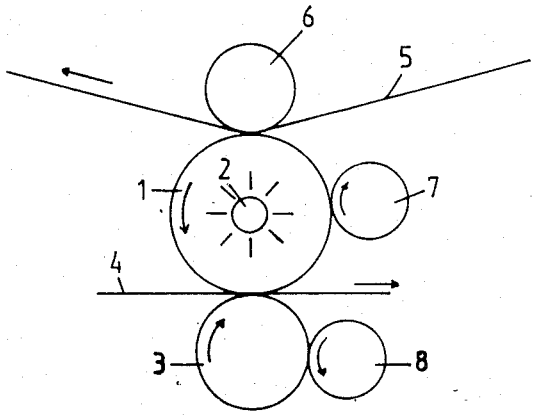

The above mentioned and other objects and features of the invention will be further evident from the following description and the accompanying drawings of an illustrative embodiment of the invention. In the drawings:

FIG. 1 is a diagrammatic cross-sectional view of a contact fixing and cleaning apparatus according to the invention; and FIG. 2 is a view of a cleaning roller of the kind used in the apparatus of FIG. 1.

The contact fixing apparatus illustrated in FIG. 1 comprises a circulating contact fixing member, here shown in the form of a roller 1, which is covered with a layer of silicone rubber and is rotatable in the direction of the arrow. Contact fixing roller 1 is heated by a heating element 2 disposed inside the roller. A second circulating fixing member, here shown in the form of a pressure roller 3 and also coated with silicone rubber, is pressed against the contact fixing roller 1. A copy sheet 4 is fed between the contact fixing roller 1 and the pressure roller 3 by conveyor means (not shown).

A photoconductive belt 5 is brought into contact with the contact fixing roller 1 at its side remote from the pressure roller 3, by means of a roller 6. A toner image applied to the photoconductive belt is transferred to the roller 1 in the nip between the belt 5 and the contact fixing roller 1. The image is softened by heat while being carried on the fixing roller 1, and then is pressed into the nip between roller 1 and the pressure roller 3. In the latter nip, the softened toner image is transferred to the copy sheet 4 and then is fixed thereon.

In the course of operation, the contact fixing roller 1 and the pressure roller 3 each comes into contact with a surface that may be carrying a heat-softened toner image or residues thereof. The surface of each of these rollers in its path beyond the nip between these rollers must therefore be freed of image residues and paper dust which, if not removed, would tend to build up and adversely affect copy quality.

At the side of the contact fixing roller 1 where its surface moves toward the photoconductive belt 5, i.e., beyond or downstream from its zone of contact with a copy sheet 4, a cleaning roller 7 is pressed against the roller 1. Similarly, a cleaning roller 8 is pressed against the pressure roller 3 at a location beyond its nip of pressing contact with fixing roller 1 or a copy sheet 4 in that nip.

The respective lines of pressing contact between the surfaces of the circulating cleaning members, here shown as rollers 7 and 8, and the surfaces of the circulating image fixing members, here being silicone rubber coated rollers 1 and 3, constitute contact cleaning zones through which the respective pressing roller surfaces move together in rolling contact each against and with the other. Accordingly, in this embodiment, each cleaning roller surface and the related fixing member surface contact one another at substantially the same velocity without substantial relative movement between them in the related contact cleaning zone.

In operation, the surface of a cleaning roller 7 or 8 and the surface of the related fixing roller 1 or 3 are moved together through the related contact cleaning zone, and residues of heat-softened toner and paper dust present on the fixing roller surface are collected in the toner layer on the cleaning roller surface, to which the toner adheres preferentially. The residues so collected are pressed into a thin toner layer on the cleaning roller surface, which on repeated movements of that surface through the contact cleaning zone is continually pressed thin so that any excess of toner or other material present in it will be displaced on the surface of the cleaning roller. This displacement is utilized to effect removal of the excess material from the cleaning roller surface, as will become further apparent below, by the provision of a multiplicity of perforations 11 and 12 formed in the surface of the cleaning roller, and preferably further by the positioning of the cleaning roller 7 or 8 relative to the related fixing roller 1 or 3.

Each of the cleaning rollers 7 and 8 is preferably disposed with its axis of rotation inclined at a slight angle to a line perpendicular to the direction of movement of the surface of the related fixing roller 1 or 3, respectively, through the related contact cleaning zone. As a result of this inclination, the surface of the cleaning roller bears against the surface of the fixing roller along an inclined line of pressure so that during the movement of these surfaces through the cleaning zone a lateral component of displacement is continually imparted to excess material in the toner layer formed on the cleaning roller surface.

The extent of the lateral displacement of toner on the cleaning roller surface varies with the degree of inclination of the line of pressure between the two surfaces. Generally an angle of 89.7° relative to the direction of advance of the fixing member surface in the contact cleaning zone is adequate. In the case of a cleaning roller having a length of 40 cm, this angle corresponds to a 2 mm deviation from the position perpendicular to the said direction of movement. An angle of 89.9° is sufficient to give a clear effect, and an angle less than 89.3° is generally unnecessary. It must be noted in this connection that the minimum angle is restricted in cases in which the fixing member to be cleaned is in the form of a roller, as the diameter of the roller limits the degree to which a cleaning roller can be inclined relative to it while being kept in pressing contact with it over the entire width of its surface.

The cleaning rollers 7 and 8 are hollow. Each of them has an array of openings or perforations, which extend into the cavity inside the roller, formed in its cleaning surface that moves into contact with the silicone rubber layer of the related contact fixing roller 1 or pressure roller 3. A preferred arrangement of these perforations is illustrated in FIG. 2, and preferably is the same for each of the rollers 7 and 8, which can be identical.

As shown in FIG. 2, perforations 11 having for example a diameter of 3 mm are disposed near each edge of each cleaning roller and about its cylindrical surface. These openings, which are located outside the active cleaning area of the roller surface, receive any toner displaced to the roller edge, in order to prevent toner from dropping over the edge of the cleaning roller and escaping uncontrollably.

Between the rows of marginal perforations 11, rows of perforations 12 are formed in the active area of the cleaning roller surface and disposed about it along a double helix. The diameter of these perforations is not critical, but an optimum diameter can be indicated. On the one hand, it is desirable to make them relatively large in order to enable rapid discharge of toner through them. On the other hand, it is desirable to keep them small because they themselves have no cleaning action, and relatively small openings will prevent the silicone rubber coating of the contacting fixing member from being damaged by excessive differences in deformation at and next to the perforations. Since the rate of discharge of toner through the perforations depends on the viscosity of the toner at the processing temperature, the optimum diameter of the perforations 12 should be determined experimentally for each set of use conditions. This diameter generally is between 1 and 2 mm.

The center-to-center distance or space between the perforations is also variable considerably without critical effect. On the one hand, a relatively large area of uninterrupted cleaning surface is desirable, yet it is important to have the toner on the cleaning surface able to reach an opening sufficiently rapidly. Since the rate of toner displacement on that surface depends on the toner viscosity, the optimum center-to-center distance for given conditions of use should be determined experimentally in relation to the toner viscosity involved. In most cases, the center-to-center distance is between 4 and 6 mm.

Although the cleaning roller 7 or 8 has no cleaning action in the small areas where its surface is interrupted by the perforations, this condition does not cause problems because, after a limited number of circulations of the contacting surfaces through the cleaning zone, each part of the silicone rubber surface will have come into contact with an imperforate part of the cleaning roller surface. Even when the circumference of the circulating fixing member is the same as that of the cleaning roller these two elements apparently rotate sufficiently asynchronously to ensure that a given perforation will not come into contact twice with exactly the same spot on the fixing member surface during two consecutive circulations. In order, however, to press on the silicone rubber surface with the cleaning roller as uniformly as practicable, and to keep the thickness of the toner layer on the cleaning roller as uniform as practicable, it is desirable to ensure that all parts of the silicone rubber surface will come with approximately uniform frequency into contact with perforations in the cleaning surface. This result can be obtained by having the perforations disposed in rows each of which extends along a helix in the surface of the cleaning roller.

Since the toner collected on the cleaning roller is largely discharged via the perforations, the surface of the cleaning roller at some places may eventually be without a toner layer thereon, and thus may have too little a tendency to take up paper dust. The action of the cleaning roller can be further improved in this respect by developing with toner from time to time, in a copier, a photoconductive strip having a surface of the same dimensions as the cleaning surface of the cleaning roller and conveying this strip with its developed toner layer through the contact fixing apparatus without supplying a sheet material to receive the toner. In this way the circulating fixing member or roller that contacts the developed toner layer, and then in turn its related cleaning roller, is provided with a layer of fresh toner that readily picks up paper dust.

The most suitable materials for construction of the cleaning rollers are metals, such as steel or aluminum, but the cleaning rollers may also be made of heat-resistant plastics to the extent comporting with the operating temperature of the apparatus. If the cleaning roller is not kept sufficiently at a toner softening temperature by the heating elements provided for heating the toner image, the cleaning roller can be heated separately; for example, by a heating element incorporated in this roller.

Although the above-described embodiment of the invention relates to a contact fixing apparatus and method in which the contact fixing member also functions as an intermediate medium or carrier for the toner image to be fixed, the invention also relates to and is beneficial for contact fixing systems in which the contact fixing member serves only to fix an image previously applied to a receiving material.

We claim:

1. A method of removing residues of heat-softened toner and paper dust from the surface of a circulating image fixing member, such as a roller or a belt, that is moved repeatedly through an image fixing zone in which said surface and the surface of a second such circulating fixing member press one against the other to fix a heat-softened toner image being carried into said zone onto a sheet material being passed therethrough between the two surfaces, which method comprises:

moving with a said fixing member surface through a contact cleaning zone of its path beyond said fixing zone a circulating cleaning surface having thereon a toner layer to which said toner and paper dust will adhere preferentially rather than to said fixing member surface, said cleaning surface having a multiplicity of spaced-apart perforations therein for discharging residues from it;

in said cleaning zone collecting residues from the said fixing member surface onto and pressing them into said toner layer on areas of said cleaning surface outside said perforations;

and by repeated movement of said cleaning surface with said fixing member surface through said cleaning zone continually pressing said toner layer thin and displacing excess material from it into said perforations.

2. A method according to claim 1, and in said cleaning zone maintaining between said cleaning surface and said fixing member surface a line of pressure inclined relative to the direction of movement of said fixing member surface so that a lateral component of displacement is continually imparted to excess material in the toner layer on said cleaning surface.

3. A method according to claim 1 or 2, each said fixing member being a roller having its surface formed by a layer of silicone rubber and said cleaning surface being a heat-resistant metal or plastics roller surface.

4. A method according to claim 1 or 2, wherein for each said fixing member a cleaning surface as aforesaid is moved with the fixing member surface through a contact cleaning zone as aforesaid, residues are collected from the fixing member surface and pressed into a toner layer on the cleaning surface as aforesaid, and the toner layer is continually pressed thin and excess material displaced from it into perforations in the cleaning surface as aforesaid.

5. A method according to claim 4, each said fixing member being a roller having its surface formed by a layer of silicone rubber and each said cleaning surface being a heat-resistant metal or plastics roller surface.

6. In a contact fixing apparatus for fixing images of heat-softenable toner onto sheet material, including a circulating image contacting fixing member and a circulating second fixing member, said members having respective peripheral surfaces that press one against the other in and move together through a contact fixing zone to fix a heat-softened toner image being carried into said zone onto a sheet material being passed therethrough in the nip between said surfaces, means for removing residues of heat-softened toner and paper dust from said surface of a said fixing member, comprising in a contact cleaning zone of the path of the said fixing member surface a circulating cleaning member having a peripheral surface to which said toner will adhere preferentially rather than to said fixing member surface, said cleaning member surface contacting said fixing member surface in and being movable with it through said cleaning zone to collect residues from it and press them into a toner layer carried on said cleaning member surface, and said cleaning member surface having a multiplicity of spaced-apart perforations therein which are so disposed that on repeated movements of said cleaning member surface with said fixing member surface through said cleaning zone said toner layer while being continually pressed thin has excess material present in it displaced from it into said perforations.

7. An apparatus according to claim 6, said cleaning member surface and said fixing member surface bearing one against the other in said contact cleaning zone along a line of pressure inclined relative to the direction of movement of said fixing member surface so that a lateral component of displacement is continually imparted to excess material in the toner layer on said cleaning member surface.

8. An apparatus according to claim 7, said cleaning member being a roller the axis of which is disposed at an angle of between 89.3° and 89.9° to the direction of movement of said fixing member surface through said contact cleaning zone.

9. An apparatus according to claim 6, said cleaning member being a roller containing in an active area of its surface that contacts said fixing member surface perforations disposed in at least one row extending along a helix in the roller surface.

10. An apparatus according to claim 8, said roller containing in an active area of its surface that contacts said fixing member surface perforations disposed in at least one row extending along a helix in the roller surface.

11. An apparatus according to claim 9 or 10, said perforations in said active surface area being disposed in two substantially parallel helical rows.

12. An apparatus according to claim 9, said cleaning roller surface containing in opposite edge regions thereof perforations disposed in substantially circular rows for receiving and discharging toner displaced laterally from said active surface area.

13. An apparatus according to claim 6, 7, 8, 9, 10, or 12, said cleaning member surface containing spaced-apart perforations of between 1 and 2 mm in diameter.

14. An apparatus according to claim 6, 7, 8, 9, 10, or 12, said perforations being spaced apart at a center-to-center distance of between 4 and 6 mm.

15. An apparatus according to claim 13, said perforations being spaced apart at a center-to-center distance of between 4 and 6 mm.

16. An apparatus according to claim 6, 7, 8, 9, 10, or 12, each said fixing member being a roller having its said surface formed by a layer of silicone rubber and said cleaning member surface being a heat-resistant metal or plastics roller surface.

17. An apparatus according to claim 6, 7, 8, 9, 10, or 12, wherein a circulating cleaning member as aforesaid is provided in a contact cleaning zone of the path of said surface of each of said circulating fixing members.

18. An apparatus according to claim 17, each said fixing member being a roller having its said surface formed by a layer of silicone rubber and each said cleaning member surface being a heat-resistant metal or plastics roller surface.

* * * * *